United States Patent [19]

Nagatani et al.

[11] 4,329,417

[45] May 11, 1982

[54] SILVER HALIDE PHOTOGRAPHIC MATERIAL AND METHOD OF FORMING HIGH CONTRAST SILVER IMAGES

[75] Inventors: Toshio Nagatani; Takeshi Habu; Kazuo Takahashi, all of Hino, Japan

[73] Assignee: Konishiroku Photo Industry Co., Ltd., Tokyo, Japan

[21] Appl. No.: 158,226

[22] Filed: Jun. 10, 1980

[30] Foreign Application Priority Data

Jun. 22, 1979 [JP] Japan ..... 54-79537

[51] Int. Cl.[3] ..... G03C 5/30; G03C 1/06

[52] U.S. Cl. ..... 430/264; 430/599; 430/600; 430/601; 430/603; 430/604; 430/607; 430/608; 430/610; 430/612; 430/613; 430/949; 430/438

[58] Field of Search ..... 430/949, 264–268, 430/599, 600, 601, 603, 602, 607, 604, 608, 610, 611, 613, 612

[56] References Cited

U.S. PATENT DOCUMENTS 3,891,442 6/1975 Beavers ..... 430/949
4,010,036 3/1977 Suga et al. ..... 430/949
4,192,682 3/1980 Nishina et al. ..... 430/265
4,233,400 11/1980 Fujiwhara et al. ..... 430/949
4,237,214 12/1980 Mifune et al. ..... 430/949
4,247,620 1/1981 Nagatani et al. ..... 430/949

*Primary Examiner*—Mary F. Downey
*Attorney, Agent, or Firm*—Frishauf, Holtz, Goodman & Woodward

[57] ABSTRACT

A novel method of forming high contrast silver images is provided. The method comprises steps of (1) image-wisely exposing a light-sensitive silver halide photographic material, and (2) treating the exposed material with a developer having superadditivity. The method is characterized by the co-existence of an oxidizing agent, and a water-insoluble ion pair formed by a water-soluble cationic compound such as quaternary ammonium or tertiary sulfonium salt and a water-soluble anionic compound such as organic sulfate. The method realizes high contrast photographic images by using a developer having a good preservability, without contamination of the developer, within a short period of time for the development. There is also provided a light-sensitive silver halide photographic material herein.

10 Claims, No Drawings

SILVER HALIDE PHOTOGRAPHIC MATERIAL AND METHOD OF FORMING HIGH CONTRAST SILVER IMAGES

The invention relates to a light-sensitive silver halide photographic material and a novel method of forming photographic images, particularly to novel method of forming silver images in order to obtain photographic images having high contrast, sharpness and resolving power.

More particularly, the invention relates to a novel method of forming images to be applied advantageously to high-contrast silver halide light-sensitive photographic materials such as those for printing, industrial X-ray and duplicating.

it has been known to form quite high contrast photographic images by using some kinds of silver halide light-sensitive photographic materials. For example, there is known a method of obtaining high contrast images, such as negative/positive dot or line images by using a light-sensitive material having silver chlorobromide or silver chloroiodobromide emulsion containing silver chloride in high amount (at least more than 50 mole %), whose mean grain size being less than 0.5$\mu$ and having a narrow grain size distribution and an even grain shape, and by treating the material with an alkaline hydroquinone developer containing sulfite ion in a very low concentration. Such kinds of silver halide light-sensitive photographic materials are known as the lith type photographic material and are essential for the platemaking.

The process of making dot images comprises generally steps of photographing the continuous change of manuscript on a lith type photographic material through crossed lines or a contact screen, and treating the material with an infectious developer or lith type developer.

The lith type light-sensitive material possesses in itself an insufficient contrast. Namely, when it is treated with a commercially available developer for printing papers, the gamma value 5 or 6 may be obtained at best. Moreover, there occurs fringe frequently that has to be avoided in forming dots. Therefore, it can be understood that the combination of lith type light-sensitive material with the above-mentioned developer is indispensable for making negative/positive dots.

Here, the infectious developer, or lith type developer means a developer containing substantially and exclusively hydroquinone as the developing agent and, at the same time, containing sulfite ion in a low concentration, as fully described in J. A. C. Yule; J. Franklin Inst., vol. 239, pp. 221 (1945).

As will be anticipated by the composition, the lith type developer has a poor preservability due to its susceptibility to autoxidation.

Accordingly, platemakers are obliged to maintain a complicated administration system in order to obtain high quality negative/positive dot images constantly. As remarkable advantages may be obtained by improving the preservability of lith type developer, strenuous efforts have been made therefor; and as the results, there have been made several inventions in which a superior contrast may be obtained even when a developer containing sulfite ion in a high concentration is used. Representative examples are Japanese Laid Open Patent Publication (JLOP) No. 52-18317/1977 in which non-diffusible oxidizing agents are used, and JLOP No. 53-16623/1978 in which fogging agents are used.

However, it has turned out that the former involves disadvantages such as color stain caused by the oxidizing agent, remaining and present in films, which has been reduced itself after development as it had been made non-diffusible.

Also, it has turned out that the latter invention may not improve the preservability substantially even by the increase in amount of sulfite ion, because a high pH value is required upon development.

It is yet unsolved problem to obtain light-sensitive materials having the similar contrast to those treated with a hithertoknown lith type developer, even when they are treated with a processing solution having the superadditivity and containing sulfite ion in high concentration, and therefore having substantially a good preservability.

It is, accordingly, an object of the invention to provide a novel method for obtaining high contrast silver images by using a developer having a good preservability, thus overcoming the above-mentioned defects involved in the prior art.

It is another object of the invention to provide a novel method of forming high contrast silver images which are suitable for obtaining line or dot images that may be used for platemaking or the like.

Other objects of the invention will become clear as the description proceeds.

The above-mentioned objects of the invention may be attained first by imagewisely exposing a light-sensitive silver halide photographic material having at least one silver halide emulsion layer coated on a support, the emulsion layer containing a compound capable of oxidizing the silver halide emulsion, and a water-soluble ion pair formed by linking electrostatically a water-soluble cationic compound with a water-soluble anionic compound, and then by treating the exposed material with a developer containing developing agents of a combination having superadditivity.

Here, the compound capable of oxidizing silver halide emulsion means compounds that possess such oxidation potential as to destroy substantially a part of photosensitized nuclei and contribute to desensitization when added alone to a silver halide emulsion subjected to the usual chemical ripening. They look similar to those compounds having the oxidizing property for the developer, disclosed in JLOP No. 52-18317/1977 from the aspect of materials. However, the both are virtually different each other. Namely, materials that give the electric potential between developer and silver halide are not included within the scope of the invention.

The oxidizing agents to be used in the invention are not to act on the developer but to oxidize the chemically sensitized silver halide, partly and substantially.

Meanwhile, the fogging agents disclosed in JLOP No. 53-16623/1978 act on the silver halide as the reducting agent, and show the action opposite to that in the present inventions.

That is to say, the prior art invention intends to realize the high contrast by using the fogging agents to promote selectively the development of highly exposed part (i.e. the shoulder part of characteristic curve).

The present invention, however, intends to realize the high contrast by using an oxidizing agent for the silver halide to suppress selectively the development of low exposed part (i.e. the foot part of characteristic curve) and has the advantage that no high pH value is required upon development, unlike the invention in JLOP No. 53-16623/1978.

However, if the oxidizing agents are used alone, the characteristic curve will show the low contrast and low sensitivity, and the high contrast may not be obtained (i.e. the concentrations at the foot part and the shoulder part will be suppressed equally.)

The inventors have found that the development at the foot part of characteristic curve may be suppressed exclusively by incorporating, jointly therein, a fine dispersion comprising aggregates of an oily or solid water-insoluble ion pair. Here, the cation and anion that form jointly the ion pair may be so inactive chemically as to undergo the reaction neither with the silver halide nor with the developer.

Therefore, the characteristic of the invention is the co-existance of the oxidizing agent and the water-insoluble ion pair consisting of cationic and anionic compounds. The high contrast effect may not be obtained in the absence of either component, as will be demonstrated in the hereafter working examples.

Examples of oxidizing agents, cationic compounds and anionic compounds which may be advantageously used alone or jointly in the invention are given below. It is, however, to be understood that each material is not to be confined to such examples.

[A] oxidizing agents

[A-a]

inorganic oxidizing agents alkali metal salts of permanganic acid, alkali metal salts of bichromic acid, alkali metal salts of persulfuric acid, alkali metal salts of hyprochloric acid, alkali metal salts of perhalogeno-acids such as perchloric acid, and alkali metal salts of halogeno-acids, such as chloric acid and bromic acid.

[A-b]

metal chelate oxidizing agents iron (III) and cobalt (III) complexes of EDTA (ethylenediaminetetraacetic acid) alkali metal salt, and hexamminecobalt (III) salts.

[A-c] organic oxidizing agents (A-c-1)

sodium N-chloroarylsulfonamide series compounds such as sodium N-chloro-p-dodecylbenzenesulfonamide, sodium N-chloro-p-nonylbenzenesulfonamide, or the like.

(A-c-2)

quinone series compounds such as 2-dodecylbenzoquinone, 2,5-dioctylbenzoquinone, 2-dodecyl-5-methylbenzoquinone, or the like.

[B] cationic compounds compounds represented by formulae [I] or [II]:

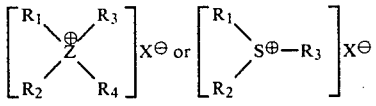

[I] [II]

In the above formulae $R_1$, $R_2$, $R_3$ and $R_4$ each represent a hydrogen atom, an optionally branched alkyl group, an aryl group or an aralkyl group. The groups may be aryl group or an aralkyl group. The groups may optionally be substituted with substituent(s), such as mono- or di-substituted amino (e.g. dimethylamino, ethylamino), aliphatic acylamino (e.g. acetylamino, t-butylcarbonylamino), aromatic acylamino (e.g. benzoylamino, m-chlorobenzoylamino), alkoxy (e.g. methoxy, ethoxy), acyl (e.g. acetyl, acryloyl), alkoxycarbonyl (e.g. methoxycarbonyl, ethoxycarbonyl), halogen, nitro, cyano, trifluoromethyl, or the like. Z represents a nitrogen atom and $X^{\ominus}$ represents a counter ion which, in itself, is water-soluble.

In order for the cationic compound to form an ion pair with a hereinafter-mentioned anionic compound electrostatistically, thus to form a water-insoluble fine dispersion, it is appropriate that the sum of carbon atoms of $R_1$, $R_2$, $R_3$ and $R_4$ (in case of compounds [I]) or of $R_1$, $R_2$ and $R_3$ (in case of compounds [II]) is about 6–50. Further, it is required that none of $R_1$, $R_2$, $R_3$ and $R_4$ contains a hydroxy group or other cationic constituents, such as quaternary nitrogen or phosphorus or tertiary sulfur atom. Furthermore none of $R_1$, $R_2$, $R_3$ and $R_4$ should contain an anion group. $R_3$ and $R_4$ may form a pyridine ring together with the nitrogen atom to which they are attached.

Representative examples of compounds [I] and [II] will be shown below.

(B-1)

trimethylammonium salts represented by formula $R_5\text{-}N^{\oplus}(CH_3)_3X^{\ominus}$ (in the formula, $R_5$ represents a hydrogen atom, a $C_{1-18}$ alkyl group or an aryl group which may optionally be substituted with substituent(s) such as halogen, nitro, cyano, amino, etc.)

for example, tetramethylammonium chloride, 1,1-dimethyl-3-nitropropyltrimethylammonium chloride, triphenylammonium perchlorate, or the like.

(B-2)

dimethylbenzylammonium chlorides represented by formula

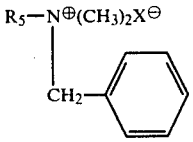

for example, trimethylbenzylammonium chloride, dimethylethylbenzylammonium chloride, (t-octylphenoxyethoxyethyl)dimethylbenzylammonium chloride, dimethyl(p-bromo)phenyl (p-bromo)benzylammonium chloride, or the like.

(B-3)

ester-linked quaternary ammonium chlorides represented by formula $R_6COOCH_2N^{\oplus}(CH_3)_2X^{\ominus}$(in the formula, $R_6$ represents a $C_{1-18}$ alkyl group optionally substituted with substituent(s), such as halogen, nitro, cyano, amino, etc.), for example, ethylcarboxymethyldimethylammonium chloride, phenylcarboxymethyldimethylammonium chloride, or the like.

(B-4)

alkyl pyridinium halides represented by formula

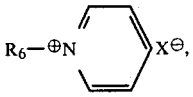

for example, methylpyridinium perchlorate, isopropylpyridinium chloride, or the like.

(B-5)

alkyldimethyl tertiary sulfonium salts represented by formula $R_7\text{-}S^{\oplus}(CH_3)_2X^{\ominus}$(in the formula, $R_7$ represents a $C_{4-18}$ alkyl group optionally substituted with substituent(s), such as halogen, nitro, cyano, amino, etc.), for example, octyldimethyl thiouronium chloride.

(B-6)

phosphonium salts represented by formula

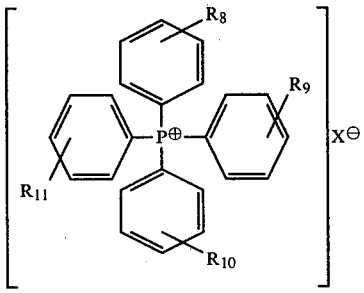

(in the formula, $R_8$, $R_9$, $R_{10}$ and $R_{11}$ have the same meaning as defined under $R_5$), for example, tetraphenylphosphonium chloride, tetra(o-chlorophenyl)phosphonium chloride, or the like.

(B-7)

benzylphosphonium compounds represented by formula 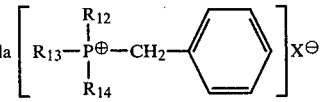

(in the formula, $R_{12}$, $R_{13}$ and $R_{14}$ have the same meaning as defined under $R_6$), for example, trimethylbenzylphosphonium chloride, triphenylbenzylphosphonium chloride, tetra(o-chloro)benzylphosphonium chloride, or the like, and other di(t-butyl)dimethylammonium chloride, n-(2,3-dichloro)triethylammonium chloride, octyltrimethylphosphine chloride, or the like.

[C] anionic compounds

The anionic compounds used in the invention contain, as the hydrophilic group, sulfonate, sulfate, carboxylate, phosphate, borate, or the like. Thereof, those containing sulfonate or sulfate are preferably employed in view of capability of forming strong ion pairs and of environmental pollution. Non-limiting list of anionic compounds to be used in the invention will be given below.

(C-1)

sulfonates represented by formula $R_{15}—SO_3^{\ominus}M^{\oplus}$ (in the formula, $R_{15}$ represents a $C_{6-18}$ alkyl group optionally substituted with substituent(s), such as halogen, nitro, cyano, amino, etc., and $M^{\oplus}$ represents a counter ion which, in itself, is water-soluble), for example, sodium triethylmethylsulfonate, sodium 1-chlorolaurylsulfonate, sodium lauryl sulfonate, sodium 9,10-dichlorooctadecylsulfonate, or the like.

(C-2)

sulfonates represented by formula

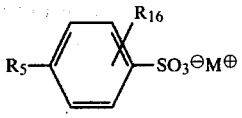

(in the formula, $R_{16}$ represented a hydrogen atom, a $C_{1-18}$ alkyl group, a nitro group or an amino group), for example, sodium dodecylbenzene-sulfonate, potassium p-chlorobenzenesulfonate, sodium p-aminophenylsulfonate, sodium xylene-sulfonate, or the like.

(C-3)

naphthalene sulfonates represented by formula

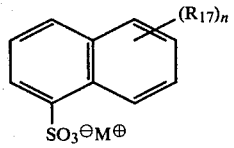

(in the formula, each of $R_{17}$ has the same meanings as defined under $R_5$, n is an integer of 1, 2 or 3 and when n is 2 or 3 $R_{17}$'s may be same or different.), for example, sodium isopropylnaphthalenesulfonate, sodium diisopropylnaphthalenesulfonate, sodium propyl-m-hexylnaphthalenesulfonate, sodium 5-benzylnaphthalenesulfonate, sodium nonylnaphthalenesulfonate, sodium triisopropylnaphthalenesulfonate or the like.

(C-4)

dialkyl sulfosuccinates represented by formula

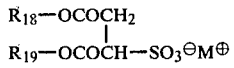

(in the formula, $R_{18}$ and $R_{19}$ have the same meaning as defined under $R_6$), for example, sodium dioctyl sulfosuccinate, sodium diamyl sulfosuccinate, potassium diamyl sulfosuccinate, or the like.

(C-5)

sulfates having a fluorocarbon chain of $-(CF_2—CF_2)_n-$ in which n is 2 to 9 inclusive, represented by formula $H(CF_2—CF_2)_nCH_2OSO_3Na$, (C-6)

alkylbenzimidazolesulfonates represented by formula

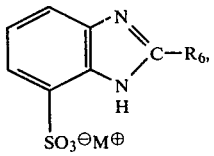

for example, potassium 2-methylbenzimidazole-4-sulfonate, sodium benzimidazole-4-sulfonate, or the like.

(C-7)

sulfates represented by formula $R_6—OSO_3^{\ominus}M^{\oplus}$, for example, octyl sulfate.

(Misc.)

sodium octahyroanthracene, or the like.

The hydrophobic ion pair of the invention to be formed from the above-mentioned cationic and anionic compounds is chemically inert to both silver halide and developer. Although the mechanism has not been made clear, it gives the contrast effect when used together with an oxidizing agent, probably due to some physical factors.

Anyway, the amount of the ion pair dispersion is more related to the density in the silver halide emulsion layer rather than to the amount of silver halide in the layer. The minimum essential amount is about $10^{-3}$ mole per gram of a binder in the layer.

As previously mentioned, JLOP No. 52-18317/1977 discloses the contrast effect attained by using a non-diffusible dispersion and PQ or MQ development. In the method, the oxidizing agent itself is made non-diffusible; this is substantially different from the present invention. Namely, in the present invention, the oxidizing agent itself is allowed to diffuse itself freely in the silver halide emulsion layer, and as the result, it flows out rapidly into the processing solution during the treatment.

Meanwhile, the ion pair dissociates partly into ions and flows out into the processing solution during the treatment, whereas it remains partly in the emulsion layer. As the ion pair is inert itself, it gives no bad influence on the preservability of films after the treatment. Rather, astonishingly, it has turned out that the remained ion pair contributes to the improvement of dimensional stability to some extent.

In the meantime, the present inventors have disclosed that the contrast effect may be attained by anions, using EDTA-Fe(III) and tetraphenylphosphonium chloride or the like, as shown in JLOP No. 55-4026/1980 (corresponding to British Laid Open Patent Publication No. 2023863 or German Offenlegungsschrift No. 29 25 284). However, no cation as the counter ion is contained therein.

As a matter of fact, EDTA-Fe(III) as an anion and tetraphenylphosphonium salt as a cation do not form a water-insoluble salt; the contrast effect is superior considerably to the control, but inferior to the combination according to the invention. Thus, more superior contrast effect to that of JLOP No. 55-4026/1980 may be attained by using a combination of said JLOP No. 55-4026/1980 and the anion of the invention. The anion is combined with the cation of JLOP No. 55-4026/1980 to form a water-insoluble dispersion, which is added EDTA-Fe(III) to make the combination according to the present invention.

The significance of the present invention resides in the fact that sulfite ion which contributes much to the preservability of developer may be added in large quantity, exceeding 15 g. per liter calculated as sodium sulfite. The value is so confined in view of improvement of preservability; the value less than 15 g. per liter may sufficiently be allowed from the viewpoint of photographic properties.

Another significance of the invention resides in the fact that the treatment with a processing solution having superadditivity has become possible; this causes a large difference from the simple hydroquinone development.

Accordingly, in this invention, the high-temperature rapid development may be performed.

Among combinations of developing agents having superadditivity according to the invention, one of the main ingredient should be hydroquinone, in view of the low price, and another may be chosen from Metol series, heterocyclic series and p-phenylenediamine series developing agents. The latter developing agents may be used either alone or jointly.

Here, the Metol series developing agents are those having formula $HO—(CH{=}CH)_n—NH_2$ and represented by 4-aminophenol, 2-amino-6-phenylphenol, 2,4,6-triaminophenol and N-methyl-p-aminophenol.

The heterocyclic series developing agents include 1-phenyl-3-pyrazolidone, 1-phenyl-4-amino-5-pyrazolidone, 1-(p-aminophenyl)-3-amino-2-pyrazoline, 1-phenyl-3-methyl-4-amino-5-pyrazolone, 5-aminouracil and 5-amino-2,4,6-trihydroxypyrimidine.

The p-phenylenediamine series developing agents include 4-amino-2-methyl-N,N-diethylaniline, 2,4-diamino-N,N-diethylaniline, N-(4-amino-3-methylphenyl)morpholine, p-phenylenediamine, 4-amino-N,N-dimethyl-3-hydroxyaniline, N,N,N',N'-tetramethyl-p-phenylenediamine, 4-amino-N-ethyl-N-(β-hydroxyethyl)aniline, 4-amino-3-methyl-N-ethyl-N-(β-hydroxyethyl)aniline, 4-amino-N-ethyl-(β-methoxyethyl)-3-methylaniline, 4-amino-3-metyl-N-ethyl-N-(β-methylsulfonamidoethyl)aniline, 4-amino-N-butyl-N-γ-sulfobutylaniline, 1-(4-aminophenyl)pyrrolidine, 6-amino-1-ethyl-1,2,3,4-tetrahydroquinoline and 9-aminojulolidine.

Silver halides to be used for the silver halide emulsion according to the invention are common to the conventional ones that tend to cause infectious development when treated with the simple hydroquinone developer. It is preferable that they are silver chlorobromide or silver chloroiodobromide containing, as the halide constituent, more than 50 mole % of chloride and that their mean grain size is from 0.1 to 0.8μ. Use of silver halides containing less than 50 mole % of chloride will result in low contrast and severe lowering of dot quality. The silver halide to be used for the invention may be prepared by any known methods disclosed, for instance, in U.S. Pat. Nos. 2,592,250; 3,276,877; 3,317,322; 2,222,264; 3,320,069 and 3,206,313, and J. Phot. Sci., 12 (5) pp. 242–251 (1964). It may contain silver halides prepared by other methods.

The silver halide emulsion to be used in this invention may be sensitized with various chemical sensitizers, for example, activated gelatin, sulfur sensitizers, selenium sensitizers, reductive sensitizers, and various noble metal sensitizers.

Further, the silver halide emulsion may be sensitized optically with one or more of sensitizing dyes in order to impart light-sensitivity at the desired light-sensitive wavelength region to the emulsion.

The silver halide emulsion to be used in the invention may be stabilized with various stabilizers.

In this invention, however, quite high-contrast light-sensitive materials may be obtained even in the absence of gradation-adjusting agents.

The above mentioned hydrophilic colloid layer may contain, if necessary, various photographic additives, for example, gelatin-plasticizers, hardeners, image-stabilizers, anti-staining agents, pH-adjusting agents, anti-oxidants, thickeners, granularity-improving agents, dyes, brightening agents, development rate-adjusting agents, matting agents, or the like.

The silver halide light-sensitive photographic material to be used in the invention may be prepared by coating a silver halide emulsion, and other hydrophilic colloid layer on a suitable photographic support. The support to be used in the invention includes baryta paper, polyethylene-coated paper, synthetic polypropylene paper, glass plate, cellulose acetate, cellulose nitrate which may be chosen depending on the purpose.

It is preferable that the silver halide emulsion layer containing the oxidizing agent is adjusted of the film characteristics, for which purpose the process usually called "film-hardening" may be applied.

In this invention, the swelling of hydrophilic colloid layer containing the non-diffusible oxidizing agent may be adjusted by applying a thin polymer onto the light-sensitive elements as disclosed in U.S. Pat. No. 3,502,501 and Japanese Patent Published Examined No. 45-33468, by including an insoluble polymer in the hydrophilic colloid layer as disclosed in Japanese Patent Publications Nos. 45-18415/1970 and 45-19951/1970, or by including, in the hydrophilic colloid layer or gelatin layer that constitutes the silver halide light-sensitive photographic material to such extent that impairs no effects of the invention, the following additives, for example, hydrophilic colloids such as colloidal albumin, agar, gum arabic, alginic acid, hydrolized cellulose acetate, acrylamide, imidated polyamide, polyvinyl alcohol and hydrolyzed polyvinylacetate, water-soluble polymers as disclosed in U.S. Pat. No. 3,341,332, British Pat. No. 523,661, and German Pat. Nos. 22 55 711 and 20 46 682, phenylcarbamyl gelatin, acylated gelatin and phthalated gelatin as disclosed in U.S. Pat. Nos. 2,614,928 and 2,525,753, and graft copolymers of gelatin with a polymerizable monomer having ethylene group such as acrylic acid, styrene, acrylic esters, methacrylic acid and methacrylic esters.

Although the objects of the invention may be attained by using silver in the light-sensitive layer, and the hydrophilic colloidal binder over quite a broad range of weight ratio, it is preferable that the hydrophilic colloidal binder is used from 0.05 to 3 times, more preferably from 0.1 to 1 time, based on the silver.

The amount of silver to be coated may be chosen, depending on the size or composition of silver halide, or the aimed characteristics, whereby the characteristics of the invention will not be influenced.

In case of dot-forming light-sensitive materials, the amount will range from 5 to 200 mg, preferably from 15 to 80 mg, per 100 $cm^2$.

The nature of developer to be used in the invention may be adjusted in various ways.

The development, after the exposure, of light-sensitive silver halide photographic material of the invention in a developer that satisfies the above-mentioned various conditions may be performed according to various embodiments. For example, it is performed at below 50° C., preferably at about 30° C., within 30 minutes, preferably within 5 minutes.

Various processes after the development, such as washing, stopping, stabilization and fixing, and prehardening and neutralization if necessary, may be performed.

According to one preferred embodiment of the invention, the stability of developer by way of plate development is more than 20 times, as compared with the conventional lith type developer. Particularly, the hithertoknown special developer, the sulfite concentration of which being extremely decreased, to be used for improvement of so-called "dot quality" of lith type light-sensitive materials loses its practical capacity after several hour's use. On the contrary, according to the preferred usage of the invention, the developer may be used stably over one month, after which period the dot quality is comparable to that of freshly prepared developer.

Further, addition of additives often used for high contrast developer, such as contrast agents and footcutting agents to the developer according to the invention gives no bad influence on the photographic functions.

The effects attained by the present invention are as follows.

(1) High contrast silver images comparable to those obtained with a conventional silver chlorobromide emulsion containing more than 50 mole % of silver chloride treated with a lith type developer may be obtained, even when treated with a developer having not so high pH value (less than 10.5) and having a good preservability, without any contamination of the developer.

(2) The treatment with a developer having superadditivity enables reduction of time for the treatment up to more than half, as compared with the conventional treatment with a lith type developer.

The invention is further explained by the following examples and referential examples, which by no means restrict the scope of the invention.

REFERENTIAL EXAMPLE 1

To 100 cc of 5% gelatin solution were added successively 3 cc of 1% sodium EDTA iron (III) complex (Compound A), and 3 cc of 1% triphenylbenzylphosphonium chloride (Compound B).

At the end of the addition, no water-insoluble constituent was found in the gelatin solution. After that, 3 cc each of 1% solutions of sodium dodecylbenzenesulfonate (Compound C), sodium laurylsulfate (Compound D) and sodium dioctylsulfosuccinate (Compound E) were added, in turn, whereby a water-insoluble white turbidity occurred in the gelatin solution.

EXAMPLE 1

A silver chlorobromide gelatin emulsion having the mean grain size 0.25μ and containing 80 mole % of silver chloride and 20 mole % of silver bromide was sensitized chemically with a sulfur sensitizer. The emulsion was coated on a polyethylene terephthalate support so that the amounts of silver and gelatin were 50 mg/100 $cm^2$ and 35 mg/100 $cm^2$, respectively to prepare Sample 1. Further, Compound A was added to the emulsion in amount of 10 cc, as 1% aqueous solution, per mole of silver. Similarly, each of compounds B to E was added to the emulsion in amount of 1.5 cc, as 1% aqueous solution, per gram gelatin to prepare Samples 2 to 6, respectively. Further, each of Compounds B to E was added to Sample 2 in amount of 10 cc, as 1% aqueous solution, to prepare Samples 7 to 10, respectively. Still further, each of Compounds C to E was added to Sample 7 in amount of 10 cc, as 1% aqueous solution, to prepare Samples 11 to 13, respectively. Each sample was coated on a support exactly in the same manner as in Sample 1.

Each of Samples thus prepared was wedge-exposed with tungsten lamp through a grey contact screen and treated in the order of the following processes:

| Process (processed at 38° C.) | |
|---|---|
| development | 45 seconds |

-continued

| Process (processed at 38° C.) | |
|---|---|
| fixing | 45 seconds |
| washing | 45 seconds |
| drying | 25 seconds |

The developer used had the following composition:

| | |
|---|---|
| phenidone | 1.0 g. |
| hydroquinone | 9.0 g. |
| sodium sulfite | 50.0 g. |
| anhydrous sodium carbonate | 45.0 g. |
| 5-nitroindazole | 60 mg. |
| sodium bromide | 3.0 g. |
| pure water | to make 1 liter. |

The results are indicated in Table 1 in terms of gamma and dot quality. The figure 5 means the best dot quality; vice versa, the figure 1 means the worst quality. The figure should be more than 3 for practical use.

TABLE 1

| Sample | Additive | | Gamma | Dot Quality |
|---|---|---|---|---|
| 1 | none | out of the scope of the invention | 0.8 | 1 |
| 2 | A | out of the scope of the invention | 1.2 | 1.5 |
| 3 | B | out of the scope of the invention | 0.8 | 1 |
| 4 | C | out of the scope of the invention | 0.8 | 1 |
| 5 | D | out of the scope of the invention | 0.8 | 1 |
| 6 | E | out of the scope of the invention | 0.8 | 1 |
| 7 | A + B | out of the scope of the invention | 8.5 | 3.5 |
| 8 | A + C | out of the scope of the invention | 1.2 | 1.5 |
| 9 | A + D | out of the scope of the invention | 1.2 | 1.5 |
| 10 | A + E | out of the scope of the invention | 1.2 | 1.5 |
| 11 | B + C | out of the scope of the invention | 1.2 | 1.5 |
| 12 | A + B + C | within the scope of the invention | 13.4 | 5 |
| 13 | A + B + D | within the scope of the invention | 11.0 | 4.5 |
| 14 | A + B + E | within the scope of the invention | 15.2 | 5 |

As shown in Table 1, Samples 12, 13 and 14 having the ternary combination of Compound A (anti-oxidant), Compound B (cationic compound) and each of Compounds C, D and E (anionic compounds) show a remarkably high contrast and a good dot quality.

REFERENTIAL EXAMPLE 2

A series of tests similar to those in Referential Example 1 were conducted, except that 1% aqueous solution of trimethylbenzylammonium chloride (Compound F) was used in place of triphenylbenzylphosphonium chloride. While no water-insoluble substance occurred in the gelatin solution in the presence of both Compounds A and B, a white turbidity occurred in the solution in the further presence of each of Compounds C, D and E.

EXAMPLE 2

Photographic materials were prepared by using the same silver halide emulsion and coating conditions as in Example 1.

The amount of addition of Compounds A, C, D and E was also the same as in Example 1. Compound F was added in amount of 1.5 cc, as 1% solution, to 1 g. of gelatin, Each of materials thus prepared was treated under the same conditions as in Example 1, using the same composition of developer.

Combination of additives in each materials and the results of gamma and dot quality are shown in Table 2.

TABLE 2

| Sample | Additive | | Gamma | Dot quality |
|---|---|---|---|---|
| 15 | F | out of the scope of the invention | 0.8 | 1 |
| 16 | A + F | out of the scope of the invention | 6.0 | 2.5 |
| 17 | A + F + C | within the scope of the invention | 12.3 | 4.5 |
| 18 | A + F + D | within the scope of the invention | 10.1 | 4.5 |
| 19 | A + F + E | within the scope of the invention | 13.5 | 5 |

As shown in Table 2, Samples 17, 18 and 19 that fall within the scope of the invention show a remarkably high contrast and a good dot quality.

EXAMPLE 3

Photographic materials were prepared in the same procedures as in Example 1, except that potassium persulfate (Compound G) was used in amount of 5 cc, as 1% aqueous solution, per mole of the silver in place of Compound A. The materials thus prepared was treated in the same manner as in Example 1, except that the developer contained 10 g. per liter of p-aminophenol in place of phenidone, and 15 g. per liter of hydroquinone.

Combination of additives in each material and the results of gamma and dot quality are shown in Table 3.

TABLE 3

| Sample | Additive | | Gamma | Dot quality |
|---|---|---|---|---|
| 20 | none | out of the scope of the invention | 0.7 | 1 |
| 21 | G | out of the scope of the invention | 1.1 | 1 |
| 22 | F | out of the scope of the invention | 0.7 | 1 |
| 23 | C | out of the scope of the invention | 0.7 | 1 |
| 24 | D | out of the scope of the invention | 0.7 | 1 |
| 25 | E | out of the scope of the invention | 0.7 | 1 |
| 26 | G + F | out of the scope of the invention | 5.0 | 2 |
| 27 | G + C | out of the scope of the invention | 1.1 | 1 |
| 28 | G + D | out of the scope of the invention | 1.1 | 1 |
| 29 | G + E | out of the scope of the invention | 1.1 | 1 |
| 30 | F + E | out of the scope of the invention | 1.1 | 1 |
| 31 | G + F + C | within the scope of the invention | 12.0 | 4.5 |
| 32 | G + F + D | within the scope of the invention | 10.5 | 4.5 |

TABLE 3-continued

| Sample | Additive | | Gamma | Dot quality |
|---|---|---|---|---|
| 33 | F + F + E | within the scope of the invention | 13.3 | 5 |

EXAMPLE 4

A silver chloroiodobromide emulsion having the mean grain size 0.25μ and containing 90 mole % of silver chloride, 9 mole % of silver bromide and 1 mole % of silver iodide was sensitized chemically with sodium thiosulfate and chloroauric acid. The emulsion was coated on a polyethylene terephthalate support so that the amounts of silver and gelatin were 40 mg per 100 $cm^2$ and 25 mg per 100 $cm^2$, respectively, to give Sample 34. Further, sodium N-chloro-p-methylbenzenesulfonamide (Compound H) was added to the emulsion in amount of 15 cc, as 1% aqueous solution, per mole of silver to give Sample 35. Likewise, each of isobutylpyridinium chloride (Compound I), dioctyldimethylammonium chloride (Compound J), tetraphenylphosphonium chloride (Compound K) and sodium isopropylnaphthalenesulfonate (Compound L) was added in amount of 3 cc, as 1% solution, per gram of gelatin to give Samples 36 to 39. Materials having the compositions shown in the following Table 4 were prepared and subjected to the development and successive procedures as under.

| Process (processed at 35° C.) | |
|---|---|
| development | 1 minute |
| fixing | 45 seconds |
| washing | 45 seconds |
| drying | 30 seconds |

The development used had the following composition:

| | |
|---|---|
| dimethylphenidone | 1 g. |
| hydroquinone | 25 g. |
| sodium sulfite | 70 g. |
| anhydrous sodium carbonate | 45 g. |
| 5-nitrobenzimidazole | 200 mg. |
| 5-methylbenzotriazole | 30 mg. |
| sodium bromide | 5 g. |
| pure water | to make 1 liter (adjusted to pH = 10.5 with sodium hydroxide) |

The results are indicated by gamma and dot quality and shown in Table 4.

TABLE 4

| Sample | Additive | | Gamma | Dot quality |
|---|---|---|---|---|
| 34 | | out of the scope of the invention | 0.9 | 1 |
| 35 | H | out of the scope of the invention | 1.5 | 1 |
| 36 | I | out of the scope of the invention | 0.9 | 1 |
| 37 | J | out of the scope of the invention | 0.9 | 1 |
| 38 | K | out of the scope of the invention | 0.9 | 1 |
| 39 | L | out of the scope of the invention | 0.9 | 1 |
| 40 | H + I | out of the scope of the invention | 1.5 | 1 |

TABLE 4-continued

| Sample | Additive | | Gamma | Dot quality |
|---|---|---|---|---|
| 41 | H + J | out of the scope of the invention | 1.5 | 1 |
| 42 | H + K | out of the scope of the invention | 1.5 | 1 |
| 43 | H + L | out of the scope of the invention | 2.5 | 1.5 |
| 44 | H + I + L | within the scope of the invention | 14.0 | 5.0 |
| 45 | H + J + L | within the scope of the invention | 13.0 | 5.0 |
| 46 | H + K + L | within the scope of the invention | 12.0 | 4.5 |

As shown in Table 4, Samples 44 to 46 that fall within the scope of the invention show a remarkably high contrast and a good dot quality.

EXAMPLE 5

Materials were prepared, using the same emulsion as in Example 4, except that 4 cc of 1% hexamine cobalt (III) chloride (Compound M) was used as the oxidizing agent in place of Compound H, and treated in the same procedures as in Example 4. Combinations of additives and the results are shown in Table 5.

TABLE 5

| Sample | Additive | | Gamma | Dot quality |
|---|---|---|---|---|
| 47 | M | out of the scope of the invention | 2.0 | 1 |
| 48 | M + I | out of the scope of the invention | 2.0 | |
| 49 | M + J | out of the scope of the invention | 2.0 | |
| 50 | M + K | out of the scope of the invention | 2.0 | 1 |
| 51 | M + L | out of the scope of the invention | 2.0 | |
| 52 | M + I + L | within the scope of the invention | 15.0 | 5 |
| 53 | M + J + L | within the scope of the invention | 15.5 | 5 |
| 54 | M + K + L | within the scope of the invention | 14.0 | 5 |

As shown in Table 5, Samples 52 to 54 that fall within the scope of the invention show a remarkable high contrast and a good dot quality.

What is claimed is:

1. A method of forming high contrast silver images which comprises the steps of (1) imagewisely exposing a light-sensitive silver halide photographic material having at least one silver halide emulsion layer coated on a support, said emulsion layer containing (A) a compound capable of oxidizing said silver halide emulsion selected from the group consisting of alkali metal salts of permanganic acid, alkali metal salts of bichromic acid, alkali metal salts of persulfuric acid, alkali metal salts of hypochloric acid, alkali metal salts of perhalogenoacids, alkali metal salts of halogeno-acids, iron (III) and cobalt (III) complexes of ethylenediaminetetraacetic acid alkali metal salt, hexamminecobalt (III) salts, sodium N-chloroarylsulfonamide compounds and quinone compounds; and (B) a water-insoluble ion pair formed by linking electrostatically a water-soluble cationic compound with a water-soluble anionic compound, said cationic compound being a compound having formula [I] or [II]:

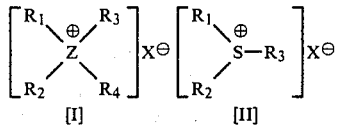

[I] [II]

wherein $R_1$, $R_2$, $R_3$ and $R_4$ each represent independently a hydrogen atom, an alkyl group, an aryl group or an aralkyl group, or $R_3$ and $R_4$ together may form with the atom to which they are attached a pyridine ring, Z represents a nitrogen atom or a phosphorus atom, and $X^{\ominus}$ represents a counter ion which is water-soluble per se, (2) treating said exposed material with a developer containing developing agents of a combination having superadditivity.

2. A method as claimed in claim 1, wherein said cationic compound is a compound having formula [I]:

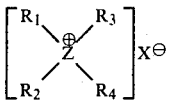

[I]

in the formula, $R_1$, $R_2$, $R_3$ and $R_4$ each represent independently a hydrogen atom, an alkyl group, an aryl group or an aralkyl group, or $R_3$ and $R_4$ together may form with the atom to which they are attached a pyridine ring, Z represents a nitrogen atom or a phosphorus atom, and $X^{\ominus}$ represents a counter ion which is water-soluble per se.

3. A method as claimed in claim 2 wherein said cationic compound is a phosphonium salt represented by the formula

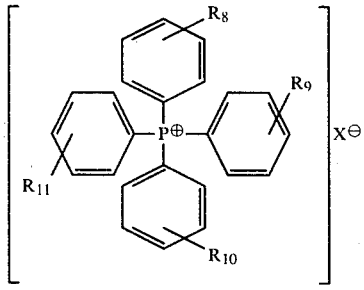

wherein $R_8$, $R_9$, $R_{10}$ and $R_{11}$ each represent a hydrogen atom, a substituted or unsubstituted alkyl group having 1 to 18 carbon atoms or a substituted or unsubstituted aryl group and $X^{\ominus}$ represents a counter ion which is water-soluble per se, or a benzylphosphonium compound represented by the formula

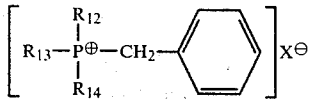

wherein $R_{12}$, $R_{13}$ and $R_{14}$ each represent a a substituted or unsubstituted alkyl group having 1 to 18 carbon atoms, and $X^{\ominus}$ has the same meaning as defined above.

4. A method as claimed in claim 3 wherein said cationic compound is a phosphonium salt as defined in claim 4.

5. A method as claimed in claim 2 or 1 wherein said anionic compound is selected from a naphthalene sulfonate represented by the formula

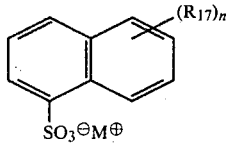

wherein each of $R_{17}$ represents a hydrogen atom, a substituted or unsubstituted alkyl group having 1 to 18 carbon atoms or a substituted or unsubstituted aryl group, $M^{\oplus}$ is a counter ion which, in itself, is water-soluble, n is an integer of 1, 2 or 3 and when n is 2 or 3 $R_{17}$'s may be the same or different, and a dialkyl sulfosuccinate represented by the formula

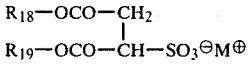

wherein $R_{18}$ and $R_{19}$ each represent a substituted or unsubstituted alkyl group having 1 to 18 carbon atoms.

6. A method as claimed in claim 5 wherein said anionic compound is a naphthalene sulfonate as defined in claim 6.

7. A method as claimed in claim 6 wherein n is selected from 1 and 2.

8. A method as claimed in claim 5 wherein n is 3.

9. A method as claimed in claim 8 wherein said anionic compound is sodium triisopropylnaphthalenesulfonate.

10. A light-sensitive silver halide photographic material having at least one silver halide emulsion layer coated on a support, said emulsion layer containing (A) a compound capable of oxidizing said silver halide emulsion selected from the group consisting of alkali metal salts of permanganic acid, alkali metal salts of bichromic acid, alkali metal salts of persulfuric acid, alkali metal salts of hypchloric acid, alkali metal salts of perhalogeno-acids, iron (III) and cobalt (III) complexes of ethylenediaminetetraacetic acid alkali metal salt, hexamminecobalt (III) salts, sodium N-chloroarylsulfonamide compounds and quinone compounds, and (B) a water-insoluble ion pair formed by linking electrostatically a water-soluble cationic compound with a water-soluble anionic compound, said cationic compound is a compound having formula [I] or [II]:

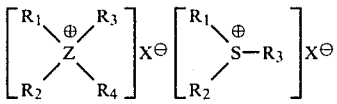

[I] [II]

wherein $R_1$, $R_2$, $R_3$ and $R_4$ each represent independently a hydrogen atom, an alkyl group, an aryl group or an aralkyl group, or $R_3$ and $R_4$ together may form with the atom to which they are attached a pyridine ring, Z represents a nitrogen atom or a phosphorus atom, and $X^{\ominus}$ represents a counter ion which is water-soluble per se.

* * * * *